US005749297A

United States Patent [19]

Récolet et al.

[11] Patent Number: 5,749,297

[45] Date of Patent: May 12, 1998

[54] DEVICE FOR CONNECTING RETAINING ELEMENTS AND A CROSSPIECE ON A PRINTING-FORM CYLINDER

[75] Inventors: Francois Récolet, Breuil-le-Vert; Jacques Métrope, Laigneville, both of France

[73] Assignees: Heidelberg Harris S.A., Montataire Cedex, France; Heidelberger Druckmaschinen AG, Heidelberg, Germany

[21] Appl. No.: 643,637

[22] Filed: May 6, 1996

[30] Foreign Application Priority Data

May 4, 1995 [FR] France ..... 95 05352

[51] Int. Cl.[6] ..... B41F 13/00

[52] U.S. Cl. ..... 101/415.1

[58] Field of Search ..... 101/415.1

[56] References Cited

U.S. PATENT DOCUMENTS

| | | | |
|---|---|---|---|
| 1,662,284 | 3/1928 | Shea | 101/415.1 |
| 1,739,585 | 12/1929 | Fleming | 101/415.1 |
| 1,788,662 | 1/1931 | Creed | 101/415.1 |
| 2,071,824 | 2/1937 | Engert | 101/415.1 |
| 3,237,558 | 3/1966 | Fagg, Jr. | 101/415.1 |
| 3,311,052 | 3/1967 | Zeuthen | 101/415.1 |
| 3,757,691 | 9/1973 | Etchell et al. | 101/415.1 |
| 4,347,788 | 9/1982 | Dufour et al. | 101/415.1 |
| 5,596,928 | 1/1997 | Marmin et al. | 101/415.1 |
| 5,613,440 | 3/1997 | Rau | 101/415.1 |
| 5,644,984 | 7/1997 | Puschnerat et al. | 101/415.1 |

FOREIGN PATENT DOCUMENTS

| | | |
|---|---|---|
| 0639454 A1 | 2/1995 | European Pat. Off. . |
| 448 134 | 3/1968 | Switzerland . |
| 2 092 069 | 8/1982 | United Kingdom . |

*Primary Examiner*—Edgar S. Burr
*Assistant Examiner*—Daniel J. Colilla
*Attorney, Agent, or Firm*—Laurence A. Greenberg; Herbert L. Lerner

[57] ABSTRACT

Device for connecting retaining elements and a crosspiece on a printing-form cylinder of a rotary printing press for fixing a flexible printing form to the circumference of the printing-form cylinder, a front edge of the flexible printing form being able to straddle a front edge of a gap formed in the cylinder, and a rear edge of the flexible printing form being fixable by at least one resilient retaining element mountable actuatably on the crosspiece and having a hook-shaped projection at an end thereof directed towards the circumferential surface of the printing form, includes a plurality of the retaining elements mountable alongside one another, and stop elements for form-lockingly locking the retaining elements on the crosspiece.

10 Claims, 3 Drawing Sheets

1
2
3
4
5
6
7
8
9
10
11
12
13
14
15
20
21
22
24
25

DEVICE FOR CONNECTING RETAINING ELEMENTS AND A CROSSPIECE ON A PRINTING-FORM CYLINDER

BACKGROUND OF THE INVENTION

1. Field of the Invention

The invention relates to a device for connecting retaining elements and a crosspiece on a printing-form cylinder of a rotary printing press for fixing a flexible printing form to the circumference of the printing-form cylinder, a front edge of the flexible printing form being able to straddle a front edge of a gap formed in the cylinder, and a rear edge thereof being fixable by at least one resilient retaining element mountable actuatably on the crosspiece and having a hook-shaped projection at an end thereof directed towards the circumferential surface of the printing form.

The published European Patent Document EP 0 639 454 A1describes a device having a withdrawable hook for holding a printing plate on a support cylinder of a rotary printing press, as well as a rotary printing press equipped with such a device.

In this device of the prior art, retaining elements having a projection in the form of a hook are introduced into a resilient system delimited by two guides, and are fixed by a first one of these guides. A projection formed on the retaining element is forced by the first guide against the second one so that the projection of the retaining element rests on a top edge or limit of the second guide, and a resilient end formed on the first guide fixes the projection of the retaining element fast over the edge or limit of the second guide.

In order to remove the retaining element, a tool is required which overcomes the resilience of the first guide and thus moves this element away from the second guide.

SUMMARY OF THE INVENTION

It is accordingly an object of the invention to provide an improvement over the prior art in the form of a device for connecting retaining elements and a crosspiece on a printing-form cylinder which enables retaining elements juxtaposed in a gap formed in a printing-form cylinder to be installed and removed more easily than in the prior art, even without a tool.

With the foregoing and other objects in view, there is provided, in accordance with the invention, a device for connecting retaining elements and a crosspiece on a printing-form cylinder of a rotary printing press for fixing a flexible printing form to the circumference of the printing-form cylinder, a front edge of the flexible printing form being able to straddle a front edge of a gap formed in the cylinder, and a rear edge of the flexible printing form being fixable by at least one resilient retaining element mountable actuatably on the crosspiece and having a hook-shaped projection at an end thereof directed towards the circumferential surface of the printing form, comprising a plurality of the retaining elements mountable alongside one another, and stop elements for form-lockingly locking the retaining elements on the crosspiece.

In accordance with another feature of the invention, the device includes guides mounted on the crosspiece, the retaining elements being insertable vertically into the guides.

In accordance with a further feature of the invention, the retaining elements are formed with recesses, and studs are included for locking with the recesses formed in the retaining elements.

In accordance with an added feature of the invention, the retaining elements are lockable on the crosspiece in a plane defined by the guides.

In accordance with an additional feature of the invention, the retaining elements are formed with recesses straddling the studs during the vertical insertion of the retaining elements.

In accordance with yet another feature of the invention, the retaining elements are lockable on the crosspiece by a translational movement thereof parallel to the axis of the printing-form cylinder.

In accordance with yet a further feature of the invention, the device includes limiters of the movement of the retaining elements parallel to the axis of the cylinder for preventing an unlocking of the retaining elements locked on the crosspiece.

In accordance with yet an added feature of the invention, the movement limiters include a flexible blade fixed to a lateral face of the cylinder.

In accordance with yet an additional feature of the invention, the movement limiters include a releasable stop fixable to a lateral face of the cylinder, after the retaining elements have been locked.

In accordance with still another feature of the invention, the stop elements are cooperatively associated with lateral edges formed on the retaining elements.

In accordance with a concomitant feature of the invention, the retaining elements are lockable on the crosspiece by a bayonet-type lock.

The advantages afforded by the solution according to the invention lie particularly in that the retaining elements can be locked faultlessly at the time of fitting or installation with the participation of the pressman and also verifiably, in spite of the narrowness of the gap, because the individual retaining elements are juxtaposed or disposed side-by-side in the gap and are mutually aligned. Moreover, the solution offered by the invention also permits simplified control, because all of the retaining elements occupy a defined mounting position.

According to an advantageous embodiment of the invention, the retaining elements are insertable vertically into guides on the crosspiece.

In addition, according to this advantageous embodiment of the invention, the retaining elements are formed with recesses which lock onto studs on a crosspiece in the manner of a bayonet lock. Locking is effected by a lateral translational movement which produces a form-locking connection, which is explained hereinafter, between the recess and the corresponding stud. Locking can be effected in a plane delimited by the two guides housed in the crosspiece. When the retaining elements are inserted vertically, they straddle the studs. A lateral translational movement is required to lock the individual retaining elements so that, in the locked state, they are juxtaposed in the gap.

Other features which are considered as characteristic for the invention are set forth in the appended claims.

Although the invention is illustrated and described herein as embodied in a device for connecting retaining elements and a crosspiece on a printing-form cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
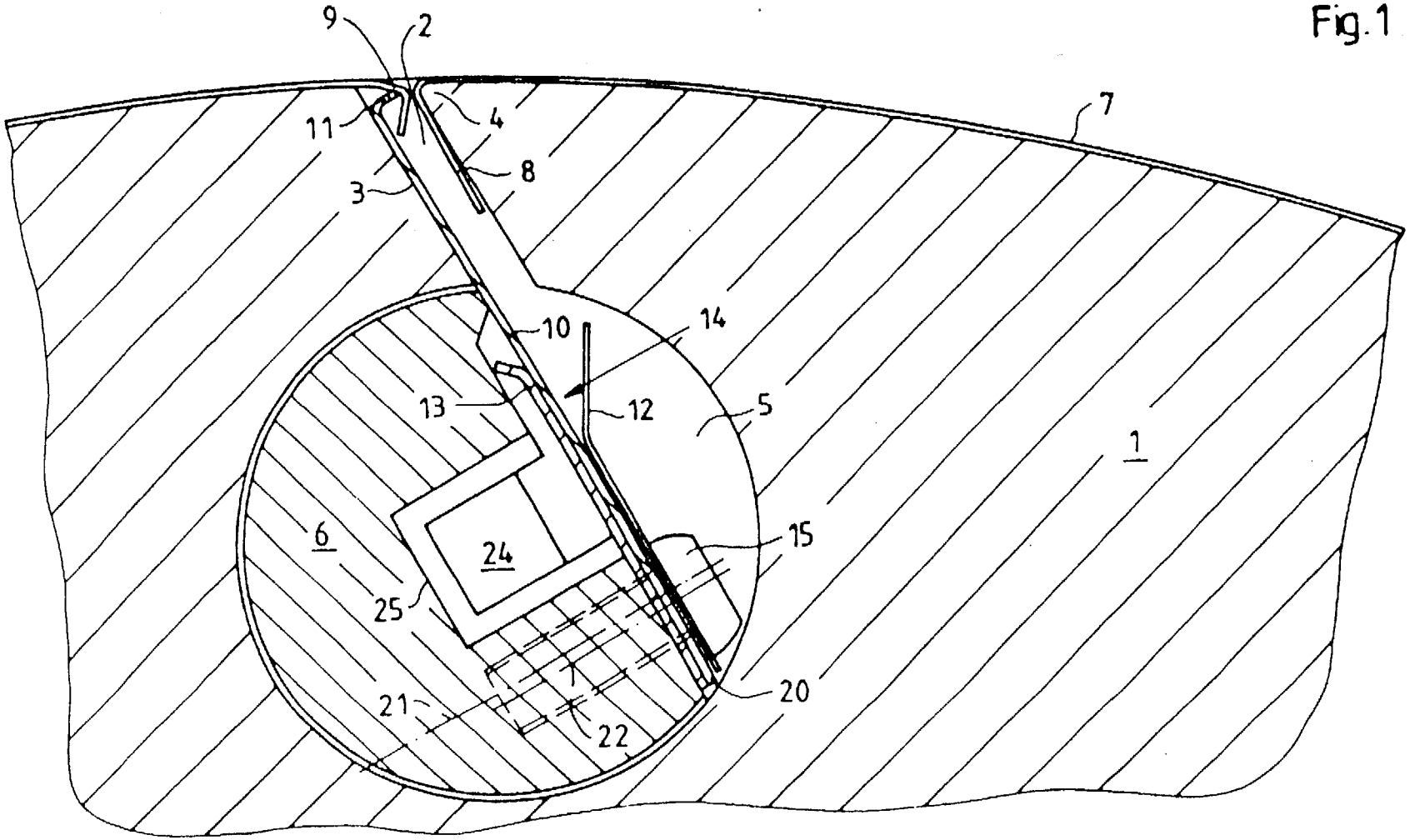
FIG. 1 is a fragmentary cross-sectional view of a printing-form cylinder in the vicinity of a cylinder lock-up gap formed therein.

Referring now to the drawings and, first, particularly to FIG. 1 thereof, there is shown therein a crosspiece 6 which, in this embodiment of the invention, is formed, for example, of a round bar and is housed in a gap 5 formed in the printing-form cylinder 1. Another gap 2 opening out at the circumferential surface of the cylinder 1 is delimited, on the one hand, by a corner 4 and, on the other hand, by a side 3. A front edge 8 of a printing form 7 bears against the corner 4, and the rear edge 9 of the printing form 7 is fixed to a retaining element 10 which abuts against the rear side 3 of the gap 2. The printing form 7 is thus stretched or tautened on the circumference of the cylinder 1.

The retaining element 10 illustrated in FIG. 1 is formed with a projection 11 in the shape of a hook which engages under the rear edge 9 of the printing form 7 and thus subjects the latter to traction. The retaining element 10, shown in FIG. 1 in locked condition, is received at the level of the crosspiece 6 between a front guide 12 and a rear guide 13. The two guides 12 and 13 define an insertion area 14. Screws 15 fix the guides 12 and 13 to the crosspiece 6, although other conventional fixing techniques are of course equally appropriate. Individual stop elements, such as studs 18, for example, are provided, the studs 18 being disposed mutually spaced apart and juxtaposed or alongside one another (note also FIG. 2) and at a distance from each other adjacent the screws and a line of symmetry 22 thereof. The studs 18 are represented only diagrammatically in FIG. 1 by a line of symmetry 21 shown in phantom, in the interest of clarity of the drawing.

The resiliently formed retaining element 10, can be received between the guides 12 and 13 so as to occupy a defined fitting or mounting position. A torsion bar 24 locked, on the one hand, in the crosspiece 6 and, on the other hand, at the ends of the printing-form cylinder 1, ensures the tension on the printing form 7.

Figure 2:
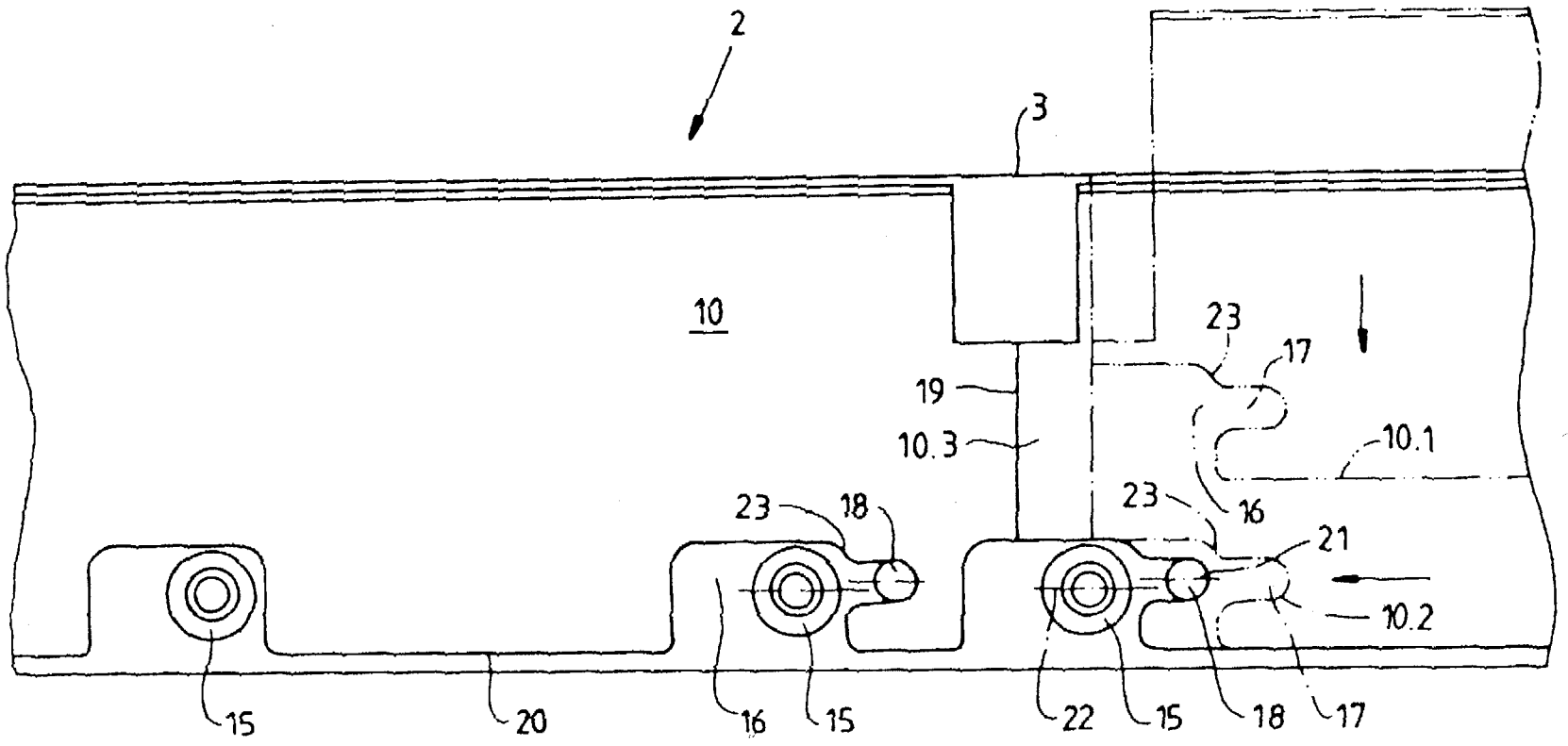
FIG. 2 is an enlarged diagrammatic view of the device according to the invention showing how the retaining elements are locked on a crosspiece.

FIG. 2 illustrates, in a simplified manner, how the retaining element is locked in the crosspiece inside the gap formed in a printing-form cylinder.

A retaining element 10, a lateral region of which is formed with a recess 16, initially occupies the position 10.1 thereof, shown in phantom, in the gap 2, of which the rear defining side 3 is visible. In the position 10.1, which is the insertion position, a recess 16 having a rounded part 23 overhangs or engages over the screw 15 and the stop stud 18 disposed alongside the latter. It is then necessary to move the retaining element 10 in the direction of the arrow oriented vertically downwards in order to place it in the position 10.2 thereof, also shown in phantom, at which it has been fully inserted. A notch 17 in the recess 16 is situated opposite the stud 18 in this position 10.2. By a lateral translational movement of the retaining element 10 in the direction of the horizontal arrow, i.e., parallel to the axis of the printing-form cylinder, the notch 17 is caused to engage around or fit over the stud 18, and the locking position 10.3 is achieved. In this regard, the edge of the recess 16 then clearly is not in contact with the screw 15; however, the notch 17 surrounds the stop stud 18. The retaining element 10 to be locked, in the mounting position 10.3 thereof in which it is locked, then abuts against the lateral edge 19 of the adjacent retaining element 10. The recesses 16, which enclose both the screws 15 and the stop studs 18, are situated on the sides of the retaining elements 10, but could also be situated in the middle thereof. The lateral movement from the pushed-in position 10.2 to the locking position 10.3 produces a form-locking connection between the stop elements formed of the notch 17 and the stud 18 and ensures a precise fit which opposes the centrifugal force to which the retaining element is subjected during the rotation of the cylinder. In regard to the foregoing, it is noted that a form-locking connection is one which connects two elements together due to the shape of the elements themselves, as opposed to a force-locking connection, which locks the elements together by a force external to the elements. The longitudinal edge 20 of the respective retaining element 10 does not abut against the bottom of the lock-up gap 2 but is situated primarily between the guides 12 and 13 (note also FIG. 1). As FIG. 2 also shows, the lines of symmetry 21 and 22 of the screw 15 and of the stop stud 18 are located so that one is slightly above the other, as FIG. 1 also shows.

Because several retaining elements 10 are juxtaposed in the gap 2 formed in the cylinder 1 and are aligned with one another, the rear edge of the printing form can be gripped over the entire width thereof, and the printing form can be fixed in a defined position on the circumference of the cylinder.

Means for limiting the movement of the retaining elements 10 parallel to the axis of the printing form cylinder 1 are also provided in order to prevent the unlocking of these retaining elements 10 on the crosspiece 6.

Figure 3:
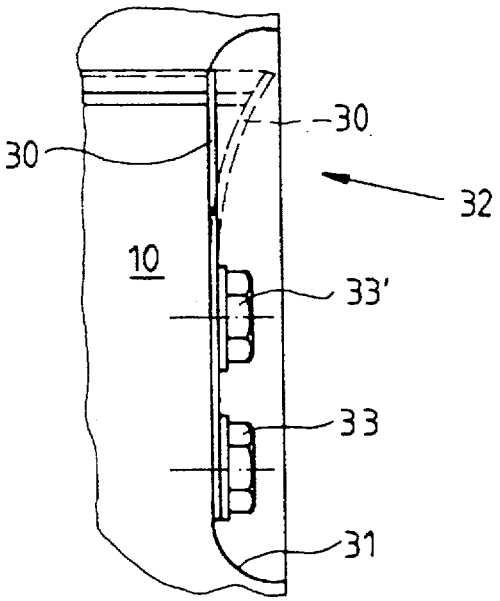
FIG. 3 is a fragmentary elevational view of FIG. 2 showing diagrammatically how the movement of the retaining elements parallel to the axis of the printing-form cylinder is limited.

As shown in FIG. 3, these movement-limiting means include a flexible blade 30, or a spring blade, fixed to one of the lateral faces of the printing-form cylinder 1, in alignment with the gap 2. In this regard, the printing-form cylinder 1 is formed with a depression 31 on the same side as the lateral face 32 thereof. The flexible blade 30 is fixed in this depression 31 by means of screws 33, 33' cooperating with threaded holes formed in the defining surface of the depression 31.

As is also apparent in FIG. 3, this flexible blade 30 is mounted on the printing-form cylinder 1 so as to limit the movement of the retaining elements 10 parallel to the axis of the cylinder 1, in the locked position of the retaining elements 10 on the crosspiece 6, which is represented diagrammatically in solid lines in FIG. 3.

In addition, this flexible blade 30 can be curved so as to permit the vertical insertion and locking of the retaining elements 10 on the crosspiece 6, as shown in broken lines in FIG. 3.

By choosing an appropriate length for this flexible blade 30, the latter can be curved by hand, without the use of a tool. The entire installation or removal of the retaining elements 10 can thus be effected without using any tool.

In a different embodiment, this flexible blade can be replaced by a rigid blade as a releasable stop which is fixable to one of the lateral faces of the printing form cylinder 1, in a manner similar to the flexible blade 30, after the retaining elements 10 have been locked on the crosspiece 6.

Naturally, the invention is not limited to the examples described and depicted, notably with regard to the shape of the means for limiting the movement of the retaining elements 10 parallel to the axis of the cylinder 1, after these retaining elements 10 have been locked on the crosspiece 6.

We claim:

1. In combination with a printing-form cylinder of a rotary printing press, the printing-form cylinder having a gap formed therein with a front edge, a device for fixing a flexible printing form having a front edge and a rear edge to a circumference of the printing-form cylinder, the front edge of the flexible printing form being able to straddle the front edge of the gap formed in the cylinder, the device comprising:

a crosspiece disposed in the gap of the printing-form cylinder;

a plurality of resilient retaining elements each having an end and a hook-shaped projection at said end and being mountable alongside one another on said crosspiece, said hooked-shaped projection directed towards a circumferential surface of the flexible printing form and engaging the rear edge of the flexible printing form for tensioning the flexible printing form;

said retaining elements having recesses formed therein; and stop elements disposed on said crosspiece for form-lockingly locking with said recesses of said retaining elements, and said retaining elements locking on said crosspiece when moved parallel to an axis of the printing-form cylinder toward said recesses.

2. The combination according to claim 1, including guides mounted on said crosspiece, and said retaining elements are insertable vertically into said guides.

3. The combination according to claim 2, wherein said retaining elements formed with said recesses straddle said stops during the vertical insertion of said retaining elements.

4. The combination according to claim 2, wherein said retaining elements are lockable on said crosspiece in a plane defined by said guides.

5. The combination according to claim 4, including a limiter for limiting movement of said retaining elements parallel to the axis of the cylinder for preventing an unlocking of said retaining elements locked on said crosspiece.

6. The combination according to claim 5, wherein said limiter includes a releasable stop fixable to a lateral face of the cylinder, after said retaining elements have been locked.

7. The combination according to claim 5, wherein said limiter includes a flexible blade fixed to a lateral face of the cylinder.

8. The combination according to claim 1, including a torsion bar mounted in said crosspiece for tensioning the printing form.

9. The combination according to claim 1, wherein said retaining elements have lateral edges formed therein and said stop elements are operatively associated with said lateral edges formed on said retaining elements.

10. The combination according to claim 1, wherein said crosspiece has a bayonet-type lock and said retaining elements are lockable on said crosspiece by said bayonet-type lock.

* * * * *